US010870956B1

(12) United States Patent
Merriam

(10) Patent No.: US 10,870,956 B1
(45) Date of Patent: Dec. 22, 2020

(54) TRAFFIC CHANNELIZER

(71) Applicant: Studio 5051, LLC, Minneapolis, MN (US)

(72) Inventor: Howard Marshall Merriam, Minneapolis, MN (US)

(73) Assignee: Studio5051, LLC, Minneapolis, MN (US)

( * ) Notice: Subject to any disclaimer, the term of this patent is extended or adjusted under 35 U.S.C. 154(b) by 0 days.

(21) Appl. No.: 16/407,023

(22) Filed: May 8, 2019

Related U.S. Application Data

(60) Provisional application No. 62/668,565, filed on May 8, 2018.

(51) Int. Cl.
*E01F 13/12* (2006.01)
*E01F 13/02* (2006.01)

(52) U.S. Cl.
CPC ..... *E01F 13/02* (2013.01)

(58) Field of Classification Search
CPC ..... E01F 13/02
USPC ..... 404/6, 9, 10; 256/13.1
See application file for complete search history.

(56) References Cited

U.S. PATENT DOCUMENTS 2,185,020 A 12/1939 Vostrez
2,603,456 A * 7/1952 Ruopp ..... E04H 17/1404 256/60
2,881,662 A 4/1959 Harris
3,447,786 A * 6/1969 Bigni ..... E01F 15/0446 256/13.1
3,537,687 A * 11/1970 Adelman ..... E04C 1/395 256/19
4,174,096 A * 11/1979 Campbell ..... E04H 17/1404 256/19
4,197,807 A 4/1980 Campbell
4,492,145 A 1/1985 Curtis
4,498,660 A * 2/1985 Brema ..... E04H 17/1404 256/12.5
4,541,190 A 9/1985 Weiner
4,597,691 A 7/1986 Clarke
4,671,495 A * 6/1987 Garland ..... E01F 7/02 104/279
4,681,302 A * 7/1987 Thompson ..... E01F 8/0035 256/13.1
4,690,583 A 9/1987 Faulconer
4,733,851 A * 3/1988 Weiss ..... E04H 17/1404 256/19
4,822,206 A 4/1989 Roussel
4,928,415 A 5/1990 Walters
4,977,697 A 12/1990 Genick
5,009,542 A 4/1991 Hardin, Jr.
5,059,060 A 10/1991 Steinhardt
(Continued)

*Primary Examiner* — Raymond W Addie
(74) *Attorney, Agent, or Firm* — Haugen Law Firm PLLP

(57) ABSTRACT

A modular system for separating traffic into discrete zones includes a plurality of rail segments pivotally secured to rail mounts. The mounts are configured for rapid and straightforward coupling of rail segments thereto. Moreover, the mounts may be quickly installed and de-installed from a road surface. The overall system therefore provides a physical barrier system that is easily installed and easily modifiable into desired arrangements. Its modular construction of any number of a plurality of distinct rail segments further facilitates customized channelizing design.

16 Claims, 7 Drawing Sheets

(56) References Cited

U.S. PATENT DOCUMENTS

| | | | | |
|---|---|---|---|---|
| 5,080,523 | A * | 1/1992 | Steiner | E01C 11/222 404/7 |
| 5,090,649 | A | 2/1992 | Wilson | |
| 5,168,678 | A * | 12/1992 | Scott, Jr. | A01G 9/02 52/102 |
| 5,168,827 | A | 12/1992 | Junker | |
| 5,498,100 | A | 3/1996 | Guernsey | |
| 5,639,178 | A | 6/1997 | Wilson | |
| 5,683,074 | A * | 11/1997 | Purvis | E04G 21/3223 256/67 |
| 5,775,833 | A | 7/1998 | Little | |
| 5,901,526 | A * | 5/1999 | Vidmar | A01G 9/28 52/745.09 |
| 6,065,900 | A | 5/2000 | Reale | |
| 6,435,762 | B1 | 8/2002 | Markling | |
| 6,508,195 | B1 | 1/2003 | Tipaldo | |
| 6,615,523 | B1 | 9/2003 | Curbelo | |
| 6,681,715 | B2 | 1/2004 | Wood | |
| 6,995,495 | B2 | 2/2006 | Ko et al. | |
| 7,011,470 | B1 | 3/2006 | Breazeale et al. | |
| 7,168,886 | B2 | 1/2007 | Loader | |
| 7,377,718 | B2 | 5/2008 | Russo | |
| 7,703,228 | B2 | 4/2010 | Zheng | |
| 7,862,252 | B2 | 1/2011 | Gelfand et al. | |
| 8,808,600 | B1 * | 8/2014 | Christensen | E01F 13/022 264/238 |
| 8,845,877 | B2 | 9/2014 | Cole et al. | |
| 2005/0220536 | A1 | 10/2005 | Blair et al. | |
| 2007/0266925 | A1 | 11/2007 | Tipaldo | |
| 2010/0266337 | A1 * | 10/2010 | Lapointe | E01F 9/629 404/11 |
| 2011/0308446 | A1 | 12/2011 | Butler | |
| 2014/0377001 | A1 | 12/2014 | Gassman | |
| 2018/0135262 | A1 | 5/2018 | Stevens | |
| 2018/0355566 | A1 | 12/2018 | Weseman et al. | |

* cited by examiner

TRAFFIC CHANNELIZER

CROSS-REFERENCE TO RELATED APPLICATIONS

This application claims the benefit of priority based on U.S. Provisional Patent Application Ser. No. 62/668,565, filed May 8, 2018 and entitled "PedRail System", the content of which being incorporated herein in its entirety.

FIELD OF THE INVENTION

The present invention relates to traffic channelizers generally, and more particularly to apparatus for defining distinct zones that separate intended traffic types, such as among motorized vehicles, non-motorized vehicles, and pedestrians. The present invention is directed to modular systems that may be used to temporarily or permanently establish distinct traffic zones being separated by a continuous or semi-continuous physical barrier.

BACKGROUND OF THE INVENTION

Traffic channelizers have long been used to direct traffic along intended and safe pathways. Examples of traffic channelizers include street painting/striping, guard rails, medians, concrete barrier walls, barrels, and cones. Each of these conventional channelizing devices and techniques, however, have their own limitations in both application and effectiveness.

As society has begun to adopt physical exercise as an important health benefit, municipalities are increasingly designating portions of streets for use only by non-motorized vehicles and/or pedestrians. Surface painting or striping of streets into designated lanes for such non-motorized vehicle and pedestrian use is the most commonly employed technique for formally establishing such designated use zones on streets that also serve motorized vehicles. Surface painting or striping, however, may sometimes be confusing to drivers of motorized vehicles, such that the zone separation intended by the municipalities is inconsistently maintained. Moreover, street conditions can obscure the painting/striping, which renders the zone designations ineffective. Sand, snow, or ice may act to obscure the visibility of painting/striping, and such painting/striping may deteriorate over time.

Another approach to establishing distinct traffic zones is through the use of permanent physical barriers, such as curbing or even completely separate pathways spaced from the motorized vehicle streets. This approach, however, is expensive, and very often not feasible given space constraints.

It is therefore an object of the present invention to provide a traffic channelizing solution that is relatively simple and inexpensive to install, but nevertheless establishes a physical barrier between the designated traffic zones.

It is another object of the present invention to provide a system for separating traffic into discrete zones that is modular in character so as to be easily customizable to the dimensions and configurations of specific applications.

It is a further object of the present invention to provide a system for separating traffic into discrete zones that is conspicuous to both drivers of motorized vehicles and users of the designated non-motorized vehicle/pedestrian traffic zone.

SUMMARY OF THE INVENTION

By means of the present invention, discrete traffic zones may be defined by a modular physical barrier that may be quickly installed and de-installed to meet customized needs and configurations. The modular system of the present invention may employ multiple lengths of rail segments that are pivotally connected at their respective ends to mounts that have been placed in a spaced pattern to define the desired boundary. Vertically-oriented delineators may be employed in the present system to enhance visibility and to create a more conspicuous presence in the traffic separating system. Light-reflective coatings and appliques may be applied to either or both of the delineators and rail segments to further enhance visibility of the system and safety to its users.

In one embodiment, a modular system for separating traffic into discrete zones includes a plurality of mounts anchorable to a road surface, each defining a mount axis that is substantially perpendicular to the road surface. The system may further include a plurality of rail segments each having a length along a length axis and first and second opposed ends that are pivotally securable to respective mounts for pivoting about the respective mount axis. A first rail segment may be pivotally securable to a first mount and a second mount that is spaced apart from the first mount. A second rail segment may be pivotally securable to the second mount and a third mount that is spaced apart from the first and second mounts. Respective ends of the first and second rail segments are pivotally securable to the second mount in an axially stacked arrangement along a mount axis.

In some embodiments, the system may include a delineator that is securable to a respective one of the mounts to extend axially along the respective mount axis from such mount. The delineator may be secured to the mount with a flexible joint that permits elastic deflection of the delineator from alignment with the mount axis.

In some embodiments, the mounts include a plate anchorable to the road surface and a post extending from the plate along a mount axis. The first and second ends of the rail segments may each terminate in a sleeve which is configured to engage about a respective post of the mount. The respective sleeves are pivotally securable about the respective posts.

The present invention further provides a method for separating traffic into discrete zones through the use of the modular system described herein. The method may include anchoring the mounts to the road surface in a spaced pattern to define a first traffic zone, and securing a first rail segment to first and second mounts, and securing a second rail segment to second and third mounts to define first and second traffic zones separated by the rail segments. In some embodiments, the second rail segment may be secured to the second and third mounts in an inverted orientation with respect to the first rail segment for the compact stacked arrangement.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

A traffic separator as described herein includes the basic elements of mounts and rail segments pivotally secured between a respective pair of mounts. To create a desired traffic separation configuration, therefore, the mounts may be positioned in a pattern that defines the boundary line or lines established by the rail segments. Because the rail segments may be pivotally secured to the mounts, the established boundary lines may selectively be linear or non-linear.

For the purposes hereof, the term "traffic" means the movement through an area or along a route, including the vehicles and/or pedestrians moving along a route. The traffic separation systems of the present invention may be employed with traffic on both sides of the defined boundary, or may instead be employed with traffic routed on only one side of the defined boundary.

For the purposes hereof, the term "road" means an open way for vehicles and/or people, and may include, for example, streets, sidewalks, parking lots, intersections, paths, and the like. It is contemplated that the traffic separation systems of the present invention may be employed in connection with motorized vehicular traffic, non-motorized vehicular traffic, pedestrian traffic, and combinations thereof.

Figure 1:
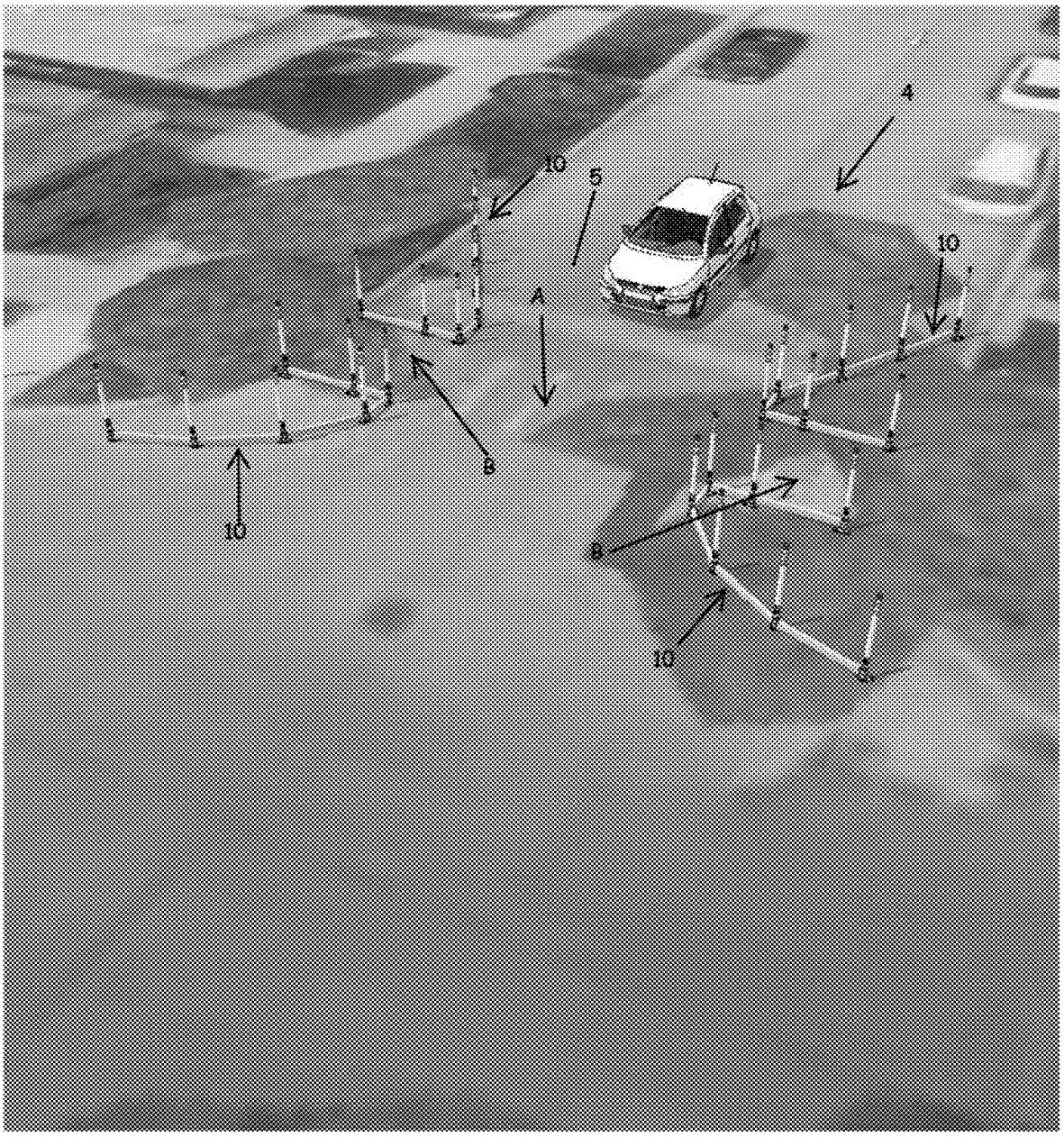
FIG. 1 is a schematic illustration of a modular traffic separation system of the present invention.

A schematic representation of the modular traffic separation system of the present invention is set forth in FIG. 1, in which system 10 is used to separate traffic into discrete zones, such as a motorized vehicle traffic zone "A" and pedestrian zones "B" of road 4. As will be described in greater detail hereinbelow, system 10 may be anchored to a road surface 5 in a desired pattern to establish the discrete zones (A, B). The schematic representation of FIG. 1 is intended to be exemplary only, in that it is contemplated that system 10 may be configured to define a wide variety of traffic zones, most notably including bicycle lanes and pedestrian lanes in a road.

Figure 2:
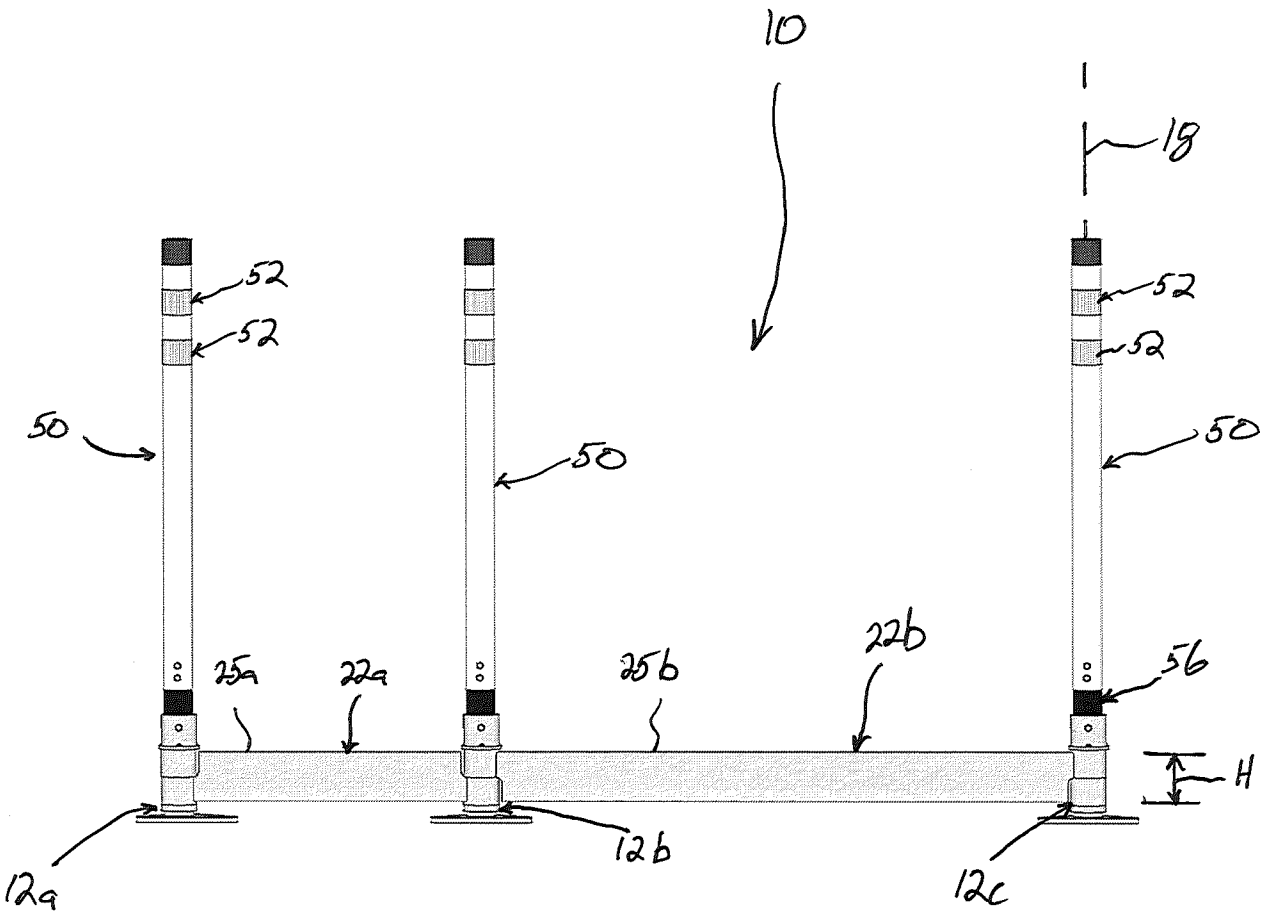
FIG. 2 is an elevational view of a modular traffic separation system of the present invention.
Figure 3:
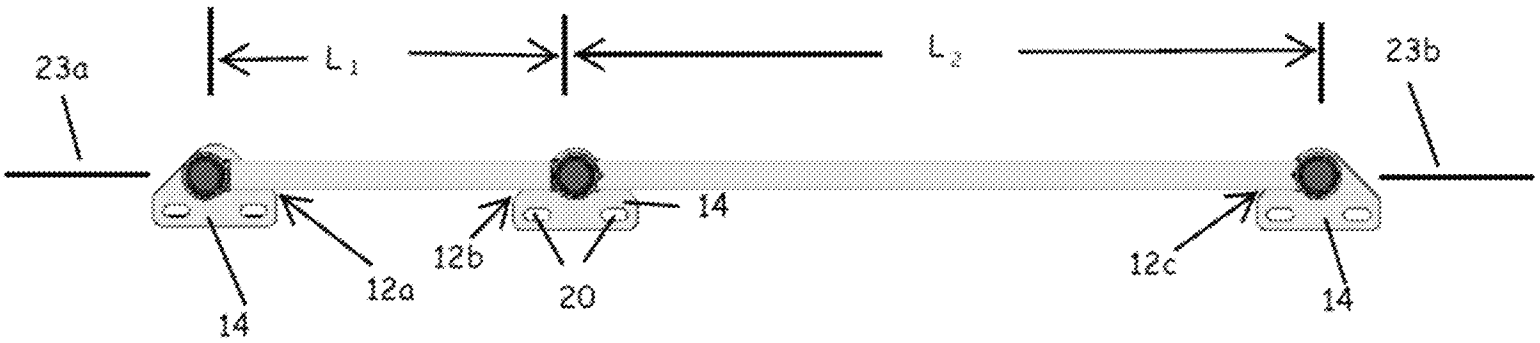
FIG. 3 is a top view of a modular traffic separation system of the present invention.

An example construction of at least a portion of system 10 is illustrated in FIGS. 2-6 with an elevational view shown in FIG. 2. System 1 includes a plurality of mounts 12 that are anchorable to road surface 5 with anchoring fasteners (not shown). Example anchoring fasteners may include bolts, such as stainless steel Titen Anchors available from Simpson Strong-Tie Company, Inc. Although various other anchoring means are contemplated by the present invention, a three-inch anchor fastener may be employed for anchoring mounts 12 to a concrete road surface 5, and a five-inch anchor fastener may be used to anchor mounts 12 to an asphalt road surface 5. In the illustrated embodiment, mounts 12 may include a plate 14 that is anchorable to road surface 5, and a post 16 extending from plate 14 along a mount axis 18. Anchoring apertures 20 may be provided at mounts 12, such as at plate 14, for receiving anchors therethrough.

In the illustrated embodiment, mounts 12 are discrete apparatus that may be arranged independently of one another. It is contemplated, however, that one or more mounts 12 may be connected to or integrally formed with a foundation body that is shaped in a linear or non-linear configuration associated with an intended boundary arrangement. An example of such a foundation body may include an elongated strip that is curved or jointed as necessary to establish the desired linear or non-linear configuration. In such an embodiment, mounts 12 may be spaced along the foundation body as deemed appropriate.

The illustrated embodiment of mount 12 includes a plate 14 that is of appropriate size and density to support modular system 10. Post 16 extends upwardly from plate 14 along mount axis 18 to suitably support one or more rail segments 22*a*, 22*b*. Post 16 is preferably configured to permit rail segments 22*a*, 22*b* to be pivotally secured to the respective mount 12. Accordingly, post 16 may be substantially cylindrical, wherein a respective cylindrical sleeve 24*a*, 24*b* may pivotally engage about post 16, as described further hereinbelow. It should be understood, however, that a variety of coupling mechanisms, and therefore physical configurations, may be implemented for mount 12 and rail segments 22*a*, 22*b* to permit pivotal coupling therebetween. Post 16 may be connected to, or integrally formed with, plate 14. In some embodiments, post 16 may be welded to plate 14.

Rail segments 22*a*, 22*b* each have a respective length "$L_1$, $L_2$" along their respective length axis 23*a*, 23*b*. Rail segments 22*a*, 22*b* have first and second opposed ends 26*a*, 26*b* that are pivotally securable to respective mounts 12 for pivoting about respective mount axes 18. In the example illustrated system 10, first rail segment 22*a* may be pivotally securable to a first mount 12*a* and a second mount 12*b* that is spaced apart from first mount 12*a*. A second rail segment 22*b* may be pivotally securable to second mount 12*b* and a third mount 12*c* that is spaced apart from the first and second mounts 12*a*, 12*b*. It is contemplated that rail segments 22*a*, 22*b* may be of equal or in equal lengths $L_1$, $L_2$ to aid in creating a desired overall boundary configuration defined by modular system 10.

Example lengths $L_1$ $L_2$ of rail segments 22*a*, 22*b* include two feet, four feet, six feet, and eight feet. Other lengths $L_1$ $L_2$, however, are contemplated as being useful in the present invention. As illustrated more clearly in the exploded views of FIGS. 4 and 5, first and second ends 26*a*, 26*b* of rail segments 22*a*, 22*b* may terminate in respective sleeves 24*a*, 24*b* which are configured to engage about respective posts 16 of mounts 12. Sleeve 24 may be substantially cylindrical and have an inner diameter that is slightly larger than an outer diameter of post 16 so that sleeve 24 may circumaxially engage post 16. To assemble rail segment 22 and mount 12, sleeve 24 may be axially guided into engagement about post 16. A projection 32 may extend radially outwardly from post 16 to support one or more rail segments 22, and particularly sleeve 24 at post 16. Projection 32 may be formed as an annular collar at or spaced axially from plate 14 of mount 12. A function of projection 32 may be to support rail segments 22 at an elevated position above road surface 5, such as by at least about 1 cm. In some embodiments, the lowermost rail segment in modular system 10 may be spaced from road surface 5 by between 1-10 cm, and more preferably between about 4-10 cm. Such spacing permits flow of water or other debris beneath rail segments 22.

Figure 4:
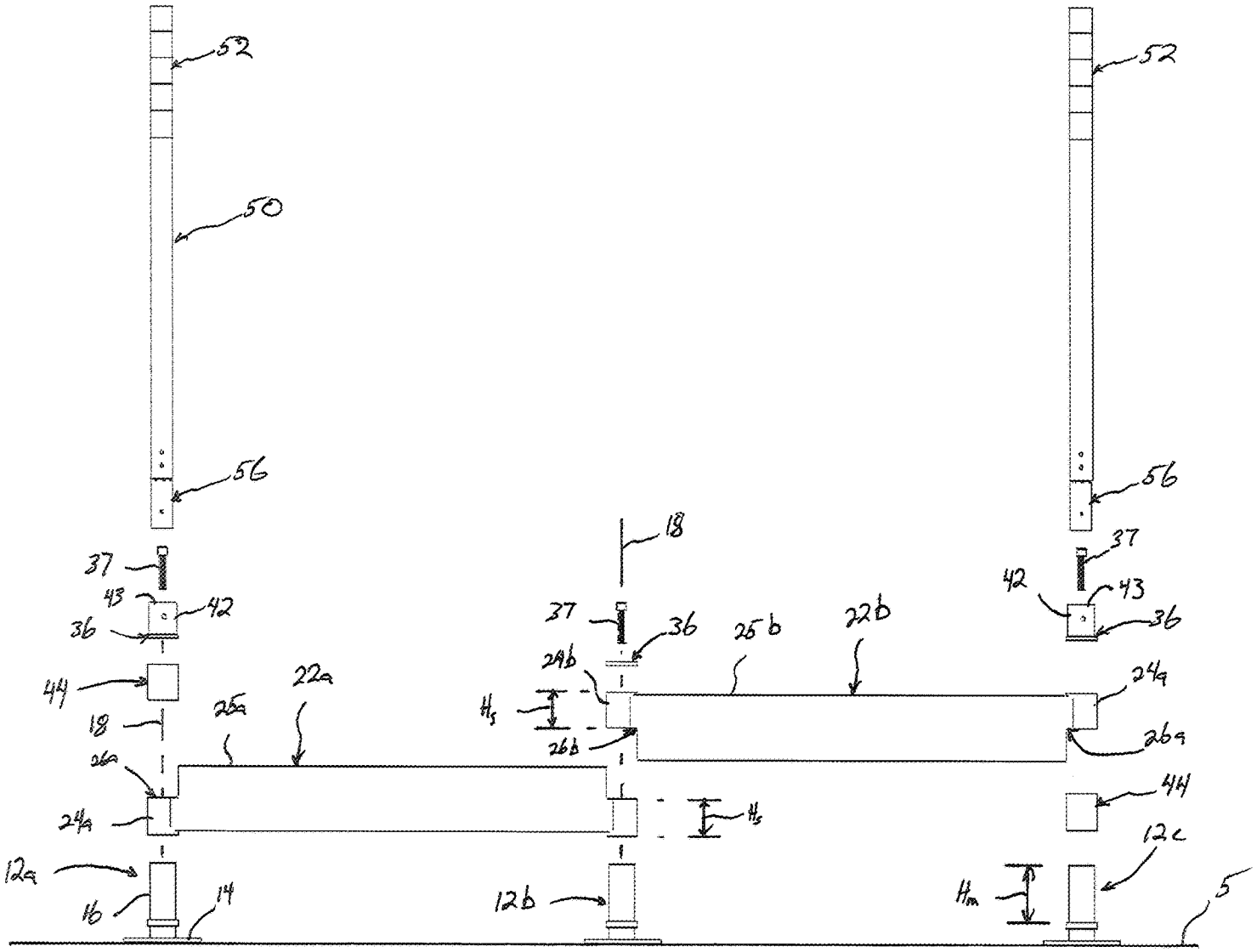
FIG. 4 is an exploded elevational view of a modular traffic separation system of the present invention.
Figure 5:
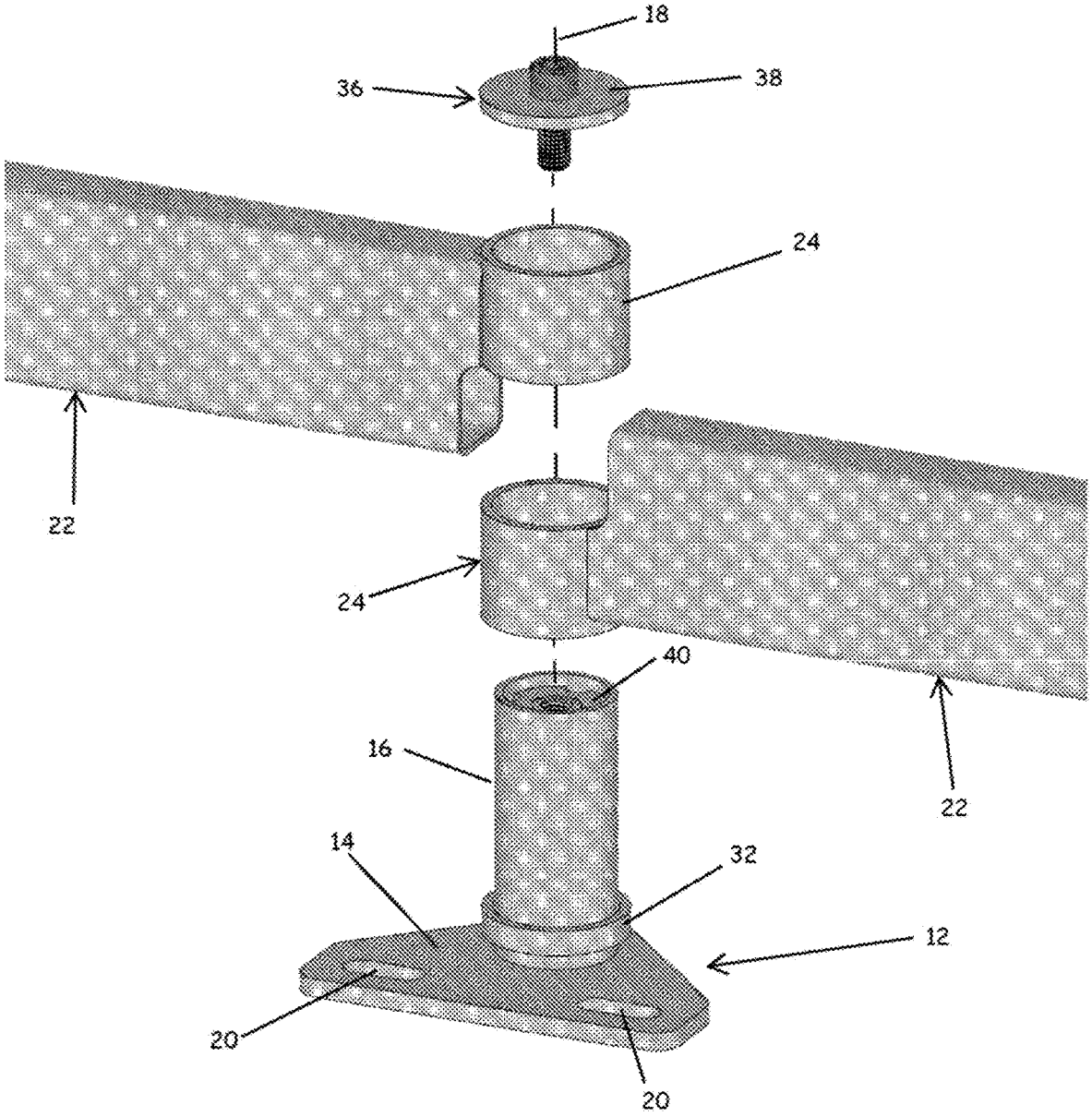
FIG. 5 is an exploded perspective view of a portion of a modular traffic separation system of the present invention.
Figure 6A:
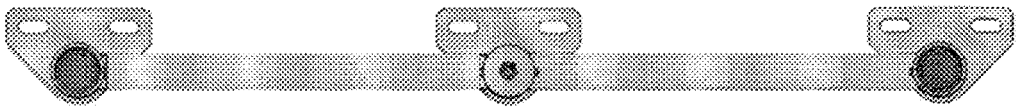
FIGS. 6A-6D are top view illustrations of a modular traffic separation system of the present invention in various relative arrangements.
Figure 6B:
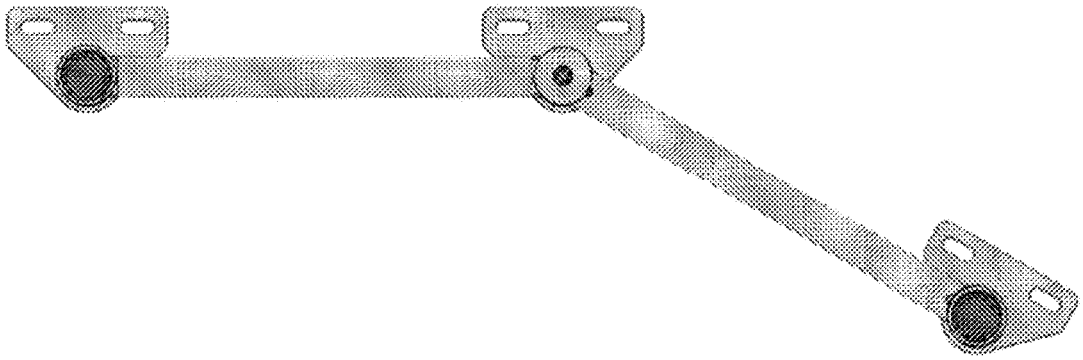
Figure 6C:
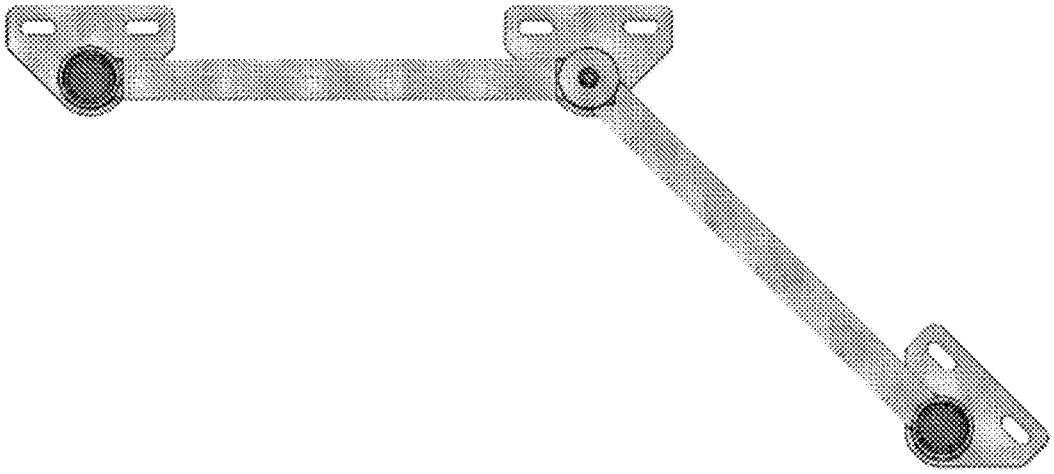
Figure 6D:
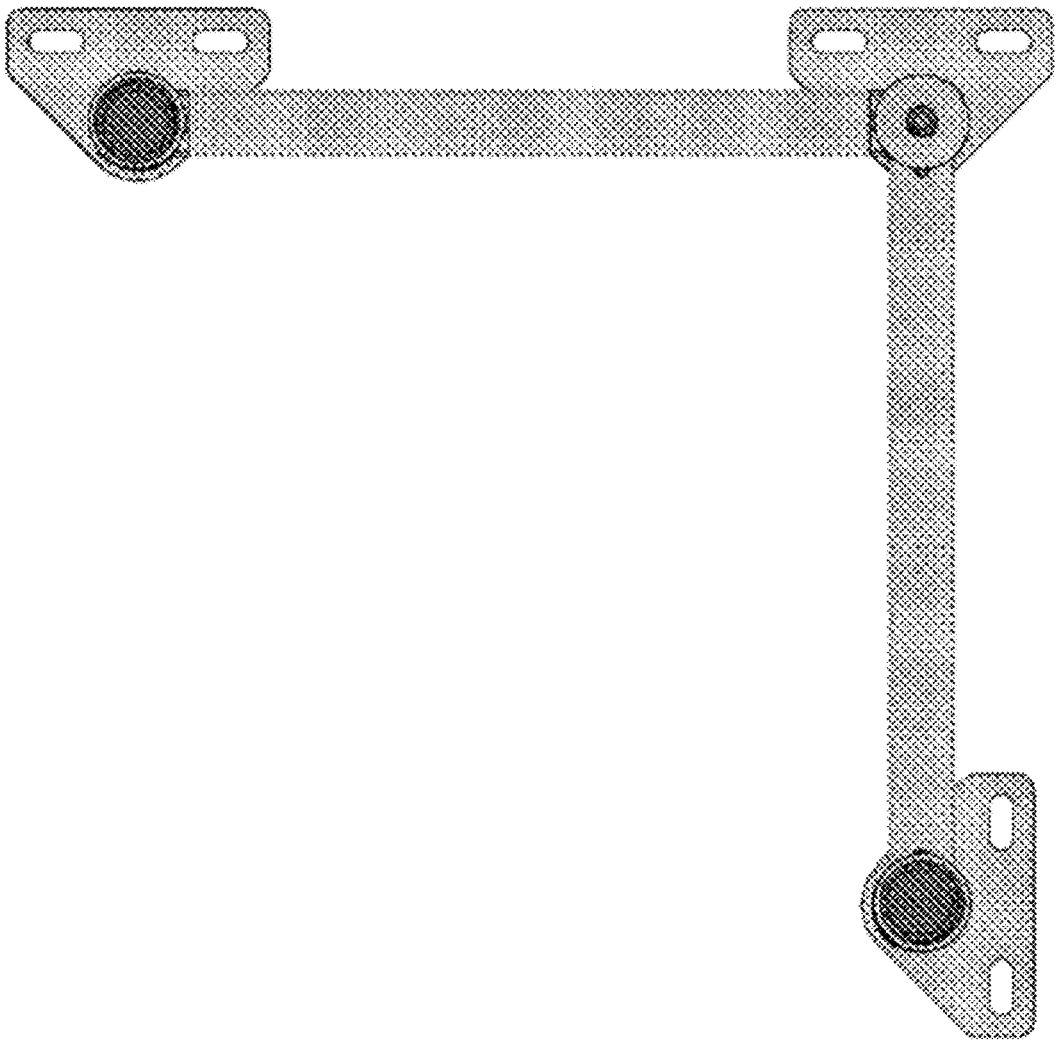

Mounts 12 are preferably configured to permit a plurality of distinct rail segments 22 to be pivotally secured thereat. By doing so, the boundary defined by rail segments 22 may be made substantially continuous. Moreover, coupling of a plurality of rail segments to a single mount reduces total hardware needed for system 10, and reduces installation time and labor. The illustrated embodiment enables a rapid and simple assembly of rail segments to a respective mount 12, simply by sequentially axially engaging sleeves 24 of respective rail segments 22 about post 16. As illustrated in FIG. 4, respective ends 26*b* of first and second rail segments 22*a*, 22*b* may be pivotally securable to second mount 12*b* in an axially stacked arrangement, with sleeves 24*b* axially stacked at and about post 16 along mount axis 18. It is contemplated, however, that other configurations may be employed to axially stack respective ends of rail segments 22*a*, 22*b* at a respective mount 12.

A particular feature of rail segments 22*a*, 22*b* is the arrangement of sleeves 24*a*, 24*b*, in which the axial stacking described above may be accomplished simply by inverting one of the rail segments with respect to the other of the rail segments at a particular mount 12. As illustrated, rail segment 22*b* may be inverted about its length axis 23*b* so that sleeve 24*b* of rail segment 22*b* is axially stackable with sleeve 24*b* of rail segment 22*a* in a manner that the total stacked axial dimension of sleeves 24*b* is substantially equal to a height "H" of rail segment 22. This way, rail segments 22*a*, 22*b* may be both pivotally securable at a single mount 12 while maintaining a substantially level plane coinciding with upper surfaces 25*a*, 25*b* of rail segments 22*a*, 22*b*.

To secure rail segments 22*a*, 22*b* at respective mounts 12, a cap 36 is preferably securable to mount 12. In some embodiments, cap 36 may be secured to mount 12, and specifically post 16, with a bolt 37 received through an aperture 38 in cap 36, and threadably engaged with a weld nut 40 secured within post 16. Weld nut 40 may, in some embodiments, be welded to an inner wall of post 16. Cap 36 may have an outer diameter that is equal to or greater than an outer diameter of sleeves 24 to retain rail segments 22 at mount 12.

Post 16 may be configured so that a mount height dimension $H_m$ is substantially equal to a sum of sleeve heights $H_s$ axially stacked at mount 12. In this manner, cap 36 secures sleeves 24 at post 16 to prevent significant axial movement of sleeves 24. Where only a single rail segment is mounted at a post 16, an end collar 44 may be engaged at post 16 to axially stack with a sleeve 24 of a respective rail segment 22. End collar 44 therefore takes up the axial space at post 16 that would otherwise be assumed by a collar 24 of an axially stacked rail segment 22.

Cap 36 may include a side wall 42 that defines a receptacle 43 for securing a delineator 50 to mount 12. Delineator 50 may be secured to extend axially along mount axis 18 from mount 12. Delineators 50 may be utilized to make modular system 10 more conspicuous. In some embodiments, delineators 50 may extend at least one meter from mount 12, although other axial dimensions for delineators 50 are contemplated by the present invention. Use of an array of delineators 50 in system 10 may significantly increase the visibility of modular system 10, and thereby enhance the safety functionality thereof. To further enhance visibility, particularly at night, light-reflective paint or decals 52 may be affixed to delineators 50.

A flexible joint 56 may be provided for securing delineator 50 to mount 12. In some embodiments, flexible joint 56 comprises a rubber body that is secured in place in receptacle 43 with a bolt, pin, or other fastener (not shown). Flexible joint 56 may be configured so that, when delineator 50 is secured to mount 12, flexible joint 56 extends axially beyond wall 42 of cap 36. The rubber body of flexible joint 56 preferably permits elastic deflection of delineator 50 from alignment with mount axis 18. Such flexibility minimizes the risk of damage to modular system 10 upon impact to a delineator 50.

FIGS. 6A-6D illustrate the pivotal connection of rail segments 22*a*, 22*b*, and how such pivotal connection facilitates a variety of linear and non-linear boundary configurations. It is to be understood that FIGS. 6A-6D represent only two adjoining rail segments, and that many applications involve a large number of pivotally connected rail segments in linear and non-linear arrangements.

It is contemplated that mounts 12 and rail segments 22 are fabricated from strong and durable materials such as galvanized steel, stainless steel, aluminum, metal alloys, polymers and polymer blends. Delineators may be fabricated from a relatively rigid and lightweight material such as various polymers. A particular design of system 10 includes mounts 12 and rail segments 22 fabricated from galvanized steel, and delineators fabricated from extruded polyvinylchloride.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A modular system for separating traffic into discrete zones, said modular system comprising:

a plurality of mounts anchorable to a road surface, each defining a mount axis substantially perpendicular to the road surface;

a plurality of rail segments each having a length along a length axis and first and second opposed ends pivotally securable to respective mounts for pivoting about said respective mount axes, with a first rail segment pivotally securable to a first mount and a second mount spaced apart from the first mount, and a second rail segment pivotally securable to the second mount and a third mount spaced apart from the first and second mounts, wherein respective ends of said first and second rail segments are pivotally securable to said second mount in an axially stacked arrangement along said mount axis; and a delineator securable to a respective said mount to extend axially along the mount axis from said respective mount, with a flexible joint connecting the delineator to the mount.

2. A modular system as in claim 1 wherein said flexible joint is rubber and extends from a bottom end of said delineator.

3. A modular system as in claim 1 wherein said mounts include a plate anchorable to the road surface and post extending from said plate along the mount axis.

4. A modular system as in claim 3 wherein said first and second ends of said rail segments each terminate in a sleeve which is configured to engage about a respective said post.

5. A modular system as in claim 4 wherein said respective sleeves of said first and second rail segments are pivotally securable about said post of said second mount in the axially stacked arrangement along said mount axis.

6. A modular system as in claim 5, including a projection extending radially outwardly from said post to support said rail segments.

7. A modular system as in claim 6 wherein said projection is an annular collar.

8. A modular system as in claim 5 wherein said first and second mounts are spaced apart along the length axis of said first rail segment, and said second and third mounts are spaced apart along the length axis of said second rail segment.

9. A modular system as in claim 1, including a cap securable to said mount to retain respective ones of said rail segments at said mount.

10. A modular system as in claim 9 wherein said cap defines a receptacle within which said flexible joint is securable.

11. A modular system as in claim 10 wherein said flexible joint permits elastic deflection of said delineator from alignment with the mount axis.

12. A modular system as in claim 11 wherein said delineator axially extends at least one meter from said respective mount.

13. A method for separating traffic into discrete zones with the modular system of claim 1, said method comprising:

(a) anchoring said mounts to the road surface in a spaced pattern; and (b) securing said first rail segment to said first and second mounts, and securing said second rail segment to said second and third mounts to define first and second traffic zones.

14. The method of claim 13, including securing said second rail segment to said second and third mounts in an inverted orientation with respect to said first rail segment.

15. The method of claim 13 wherein each of said first and second rail segments are spaced from the road surface by at least one centimeter.

16. The method as in claim 13, including securing a delineator to at least one of said first, second, and third mounts.

* * * * *